United States Patent [19]

Berenov et al.

[11] 4,260,010

[45] Apr. 7, 1981

[54] DUMMY BAR FOR USE IN MACHINES FOR CONTINUOUS CASTING OF ROUND HOLLOW INGOTS

[76] Inventors: Alexandr D. Berenov, ulitsa Krasnykh bortsov, 7-a, kv. 18; Vladislav P. Krainev, ulitsa Lunacharskogo, 210-a, kv. 24; Midkhat M. Mansurov, ulitsa Izbiratelei, 7, kv. 23; Evgeny L. Silin, ulitsa Kultury, 22, kv. 9, all of Sverdlovsk, U.S.S.R.

[21] Appl. No.: 72,419

[22] Filed: Sep. 4, 1979

[51] Int. Cl.[3] ..... B22D 11/08

[52] U.S. Cl. ..... 164/445; 164/421

[58] Field of Search ..... 164/85, 421, 425, 426, 164/445, 446

[56] References Cited

U.S. PATENT DOCUMENTS

| | | | |
|---|---|---|---|
| 3,561,522 | 2/1971 | Bosold | 164/426 |
| 4,159,734 | 7/1979 | Sladkoshteev et al. | 164/426 |

FOREIGN PATENT DOCUMENTS

| | | | |
|---|---|---|---|
| 1398063 | 3/1964 | France | 164/85 |

*Primary Examiner*—Robert D. Baldwin

*Attorney, Agent, or Firm*—Fleit & Jacobson

[57] ABSTRACT

A dummy bar successfully adapted to horizontal type machines for continuous casting of metals comprising a head with a central orifice for installing a mandrel and a bar connected to the head by a connecting assembly. The central orifice of the head has a cylindrical and a conical section. The cylindrical section of the central orifice of the head accomodates a wedging bushing with a nut. The connecting assembly is provided with a cam sleeve, each half thereof having one degree of freedom, one in the axial and the other in the tangential directions.

1 Claim, 2 Drawing Figures

DUMMY BAR FOR USE IN MACHINES FOR CONTINUOUS CASTING OF ROUND HOLLOW INGOTS

BACKGROUND OF THE INVENTION

1. Field of the Invention

The invention relates to metallurgy and more particularly to dummy bars for machines for casting round hollow ingots.

The invention can effectively be employed in horizontal-type machines for continuous casting of round hollow metal ingots.

2. Description of the Prior Art

Billets for manufacturing pipes or other hollow items are currently fabricated generally in vertical-type continuous casting machines. It is common knowledge that these machines require considerably greater investments as compared to horizontal-type continuous billet casting machines. To start casting, use is made of a dummy bar formed with a hollow pipe with bevelled top edges to ensure tightness. The dummy bar is coupled with an ingot being cast by pins sloped to the axis of the ingot and to one another.

There is also known a dummy bar which comprises a head with a central cylindrical orifice for receiving a mandrel and a bar connected to the head by a stud locked by a nut. The head is sealed inside a mould by a bushing from a material generating a gas on contact with molten metal. However, the stud connection of the dummy bar to the head suffers from a shortcoming in that the orifices for the stud on the bar and on the head of the dummy bar fail to coincide when the bar is moved axially by the withdrawal roll unit, as that it is necessary to turn the head of the bar with respect to their axes, this, in its turn, involves problems, as the rotation of the head of the dummy bar inside a mould may break the seal, whereas the bar is prevented from turning by the withdrawal roll unit.

SUMMARY OF THE INVENTION

It is therefore an object of the invention to ensure reliable sealing of the gap between the central orifice of the head and the mandrel.

Another object of the invention is to expedite the operation involving the connection of the head of the dummy bar to the bar.

Still another object of the invention is to improve service conditions of machines for continuous casting of round hollow ingots.

The above and other objects are attained in a dummy bar for machines for continuous casting of round hollow ingots, comprising a head with a central orifice for receiving a mandrel and a bar coupled with the head by a connecting assembly, according to the invention, the central orifice in the head has a cylindrical section changing to a conical section with the apex of the cone presented to the end-face of the head, contacting molten metal, the cylindrical section of the orifice of the head accommodating a wedging bushing with a nut, whereas the connecting assembly is provided with a cam sleeve, each half thereof having one degree of freedom, one in the axial and the other in the tangential directions.

The above dummy bar is easy to handle, reliably seals the gap between the central orifice of the head and the mandrel to eliminate leakage of molten metal so as to ensure a stable start of the continuous casting process, improves service conditions and expedites the connection of the head to the bar, this being achieved by a free rotation of one of the halves of the cam sleeve.

BRIEF DESCRIPTION OF THE DRAWINGS

These and other objects and features of the invention become readily apparent from one embodiment thereof which will now be described, by way of example, with reference to the accompanying drawings, in which.

DESCRIPTION OF THE PREFERRED EMBODIMENT

Figure 1:
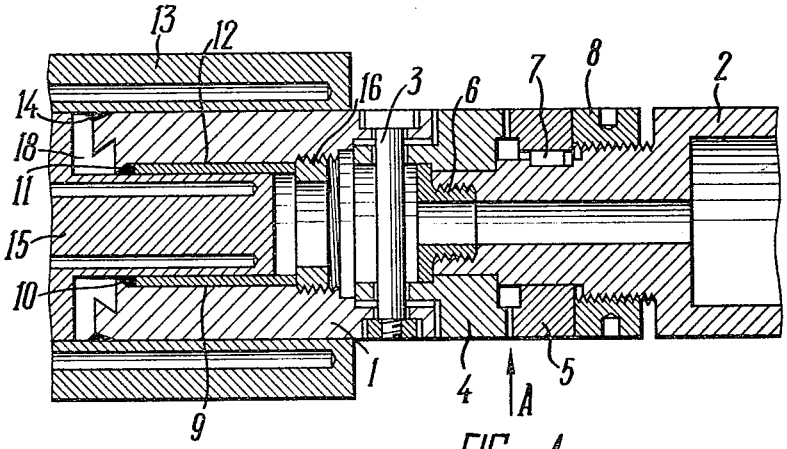
FIG. 1 is a general view of a dummy bar (longitudinal section), according to the invention.

A dummy bar comprises a head (FIG. 1) and a bar 2 connected one to another by a pin 3 and halves 4 and 5 of a cam sleeve. The pin 3 can be locked by various known elements, such as a nut or a cotter. The half 4 of the sleeve is locked against axial movement on the bar 2 by a nut 6, whereas the half 5 of the sleeve is prevented from rotating by a key 7 and, in the working position, from moving axially on the bar 2, by a nut 8.

The head 1 has a central orifice having a cylindrical section 9 changing to a conical section 10 with the apex of the cone presented to the end-face of the head 1.

The conical section 10 of the central orifice of the head 1 receives a seal 11, and the cylindrical section 9, a wedging bushing 12.

OPERATION

A machine for continuous casting of ingots using a dummy bar according to the present invention operates as follows.

Figure 2:
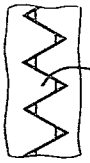
FIG. 2 is a view along arrow "A" on FIG. 1, according to the invention.

The head 1 is inserted into a mould 13 and sealed along the perimeter by a seal 14, a mandrel 15 is put in place, and the gap between the central orifice of the head 1 and the mandrel 15 is made tight. A wedging bushing 12 is placed into an annular slot between the head 1 and the mandrel 15 and locked with a nut 16 to prevent the seal 11 being dislodged by the pressure of the molten metal. Next, the bar 2, complete with the halves 4 and 5 of the cam sleeve, is moved axially by a withdrawal roll unit (omitted on the drawings) to align the axes of the orifices in the head 1 in the half 4 of the cam sleeve in a plane perpendicular to the axis of the bar 2. Once the orifices are aligned, the head 1 and the bar 2 are connected by a pin 3; should the orifices fail to register, the nut 8 is undone, the half 5 of the cam sleeve is moved axially toward the nut 8, so as to disengage the half 5 of the cam sleeve from end-face teeth 17 (FIG. 2) of the half 4 of the cam sleeve. The half 4 of the cam sleeve is then tightened until the orifice thereof coincides fully with that of the head 1, the two orifices then being connected by the pin 3. The half 5 of the cam sleeve is then moved back and engaged with the half 4 of the cam sleeve, the nut 8 is re-tightened, and the dummy bar is now ready for operation. The head 1 on the end face contacting molten metal has a fancy-shaped groove 18. When interior of the mould 13 is filled with molten metal, molten metal flows into the fancy-shaped groove 18 and solidifies thereby bonding the dummy bar to the ingot being cast. A withdrawal roll unit is then energized to start the continuous withdrawal of the ingot.

What is claimed is:

1. A dummy bar for machines for continuous casting of round hollow ingots, comprising: a head with a central orifice for receiving a mandrel; a bar coupled with said head by a connecting assembly; said central orifice of the head having a cylindrical section changing to a conical section with the apex of the cone presented to the end face of said head contacting molten metal; a wedging bushing with a nut, placed inside said cylindrical section of the central orifice of said head; said connecting assembly being provided with a cam sleeve, each half thereof having one degree of freedom, one in the axial, and the other in the tangential directions.

* * * * *